United States Patent [19]

Ericson, Jr.

[11] 4,021,092

[45] May 3, 1977

[54] ELECTRICAL CONNECTOR

[75] Inventor: John E. Ericson, Jr., Willoughby, Ohio

[73] Assignee: The Ericson Manufacturing Company, Willoughby, Ohio

[22] Filed: June 9, 1975

[21] Appl. No.: 585,028

[52] U.S. Cl. ..... 339/103 R; 339/75 P; 339/176 R

[51] Int. Cl.[2] ..... H01R 13/58

[58] Field of Search ..... 339/103 R, 103 C, 75 P, 339/62, 66 R, 176 R, 195 R, 206 P, 217 TP

[56] References Cited

UNITED STATES PATENTS

| | | | |
|---|---|---|---|
| 3,362,006 | 1/1968 | Fuller | 339/103 C X |
| 3,461,417 | 8/1969 | Schumacher et al. | 339/103 C X |
| 3,781,765 | 12/1973 | Schleicher | 339/103 R |

*Primary Examiner*—Roy Lake
*Assistant Examiner*—DeWalden W. Jones

[57] ABSTRACT

An electrical connector comprises a body defining a chamber. Electrical elements are carried by an insulating part located in said chamber. The body has an integral molded construction of resilient material and includes a generally tubular portion. An opening is provided in the end wall for an electrical cable to extend therethrough into the chamber for connection with the electrical elements. A clamp means is provided for clamping the electrical cable prior to its entry into the chamber. The clamp means comprises a clamp part and means for securing the clamp part to the insulating part. Threaded fasteners are provided which extend into threaded engagement with the clamp part. The electrical connector has means for preventing an axial compressive clamping of the body between the insulating part and the clamp part. This means comprises a portion of one of the parts for engaging the other of the parts and blocking engagement of the other of the parts with the body so that a compressive action does not occur to the body which would cause bulging thereof.

5 Claims, 2 Drawing Figures

ELECTRICAL CONNECTOR

BACKGROUND OF THE INVENTION

This invention relates to industrial-type electrical cable connectors and, in particular, to those connectors having three basic elements: (1) a rigid insulating part which carries the electrical terminals; (2) a flexible fluidtight casing which encircles the cable and isolates the electrical terminals from foreign matter; and (3) a clamping part to secure the cable and which is in turn secured to the part carrying the terminals.

A problem with connectors of the above type centers around the flexible casing. A flexible casing is fairly elastic, which elasticity provides a high quality seal. The elasticity also results in an easily deformed casing. This deformation especially occurrs upon assembly. When the rigid terminal carrying part is positioned in the chamber defined by the eleastic casing and secured with screws to the clamping part, the end wall of the casing, which is intermediate the terminal insert part and clamping part, is subjected to axial compressive forces which cause radial expansion of the external cylindrical surface of the casing. This bulging, or radial expansion, is undesirable, as it prohibits the placing of two connectors side by side in the standard dual receptacle, due to interference. A previous attempt to solve this problem included the use of fasteners to secure the clamp part and terminal part together and which slip at a point prior to the bulging of the rubber casing. This requires a special fastener construction and is costly.

SUMMARY OF THE INVENTION

The present invention solves the previously described problem without sacrificing any effectiveness of the fastening means and, at the same time, incorporates industrial simplicity and practicality. The undesirable compression of the rubber casing is prevented by the extension of integrally molded sleeves from the clamp part through holes in the rubber casing end wall. The screws which secure the terminal insert to the connectors are threaded into the sleeves, fastening the three component parts securely together at a set distance apart. No bulging of the casing occurs because the innermost surface of the terminal insert contacts the sleeves which act as a stop to prevent engagement of the terminal insert part with the rubber casing, and thus prevent any compression of the rubber casing.

An alternative method of accomplishing the same object is to integrally mold the sleeves to the terminal insert part. The screws, which enter the connector from the external surface of the terminal insert, then pass freely through the sleeves and are threaded into the clamping part. In both cases, the sleeves rigidly position the terminal insert a set distance from the clamping part and prohibit any compression of the casing end wall.

The innovative plastic sleeves, extending from either the clamping part or the terminal insert part, are narrow rigid cylinders which retain the screws (preferably self-tapping) and tunnel through the openings in the casing. The sleeves are formed integrally with the clamping part and together they comprise a one-piece molded part.

The resilient elastic casing consists of two basic portions, namely: (1) a generally tubular portion defining a chamber in which the electrical elements are located, and (2) an end wall closing one end of the tubular chamber and providing an expansible fluidtight seal encircling a cable entrance into the chamber. Due to its resilient elastic nature, cables of different diameters can be received through the end wall.

A clamp arrangement is provided to secure the cable prior to its entry into the chamber. The clamping arrangement includes the previously-mentioned clamping bracket, two gripping elements, and two fasteners. The clamping bracket is an annulus of molded plastic having on one axial side a pair of diametrically positioned protrusions and on the opposite axial side are the previously noted sleeves. The gripping elements are fastened to each side of the protrusions to secure the cable.

DESCRIPTION OF THE FIGURES

Further features of the present invention will be apparent to those skilled in the art to which it relates from the following detailed description of a preferred embodiment made with reference to the accompanying drawings in which.

DETAILED DESCRIPTION OF THE PREFERRED EMBODIMENT

The present invention provides an electrical connector of improved construction and, particularly, provides an electrical connector having means for preventing an axial clamping of a tubular flexible casing between the terminal insert and a cable clamping part. The means which prevents the axial clamping comprises plastic sleeves integrally molded to either the clamping bracket or terminal insert part, and which block any compressive action on said tubular flexible body which would result in bulging thereof.

Figure 1:
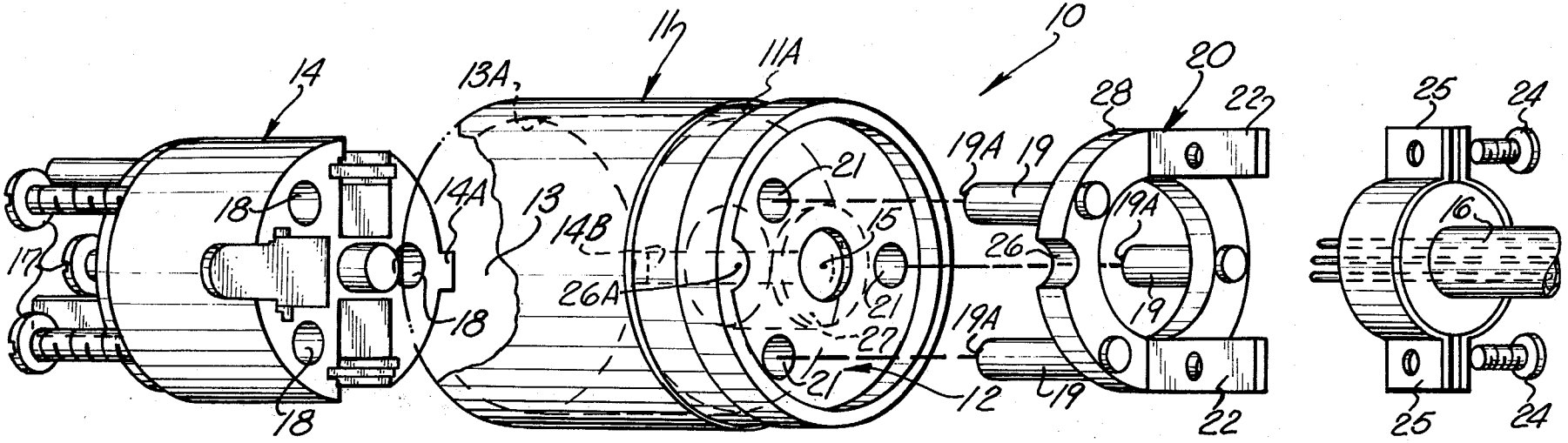
FIG. 1 is an exploded view of an electricl connector embodying the present invention.

Illustrated in FIG. 1 are the separated component parts which comprise the connector of the present invention. As illustrated, the connector comprises a support body or molded casing 10 which comprises a generally tubular portion 11 and an end wall 12. The external surface of the tubular portion 11 is generally cylindrical, but does include an encircling indentation 11A which roughly corresponds to the area where the end wall 12, a relatively narrow disc, is integrally molded to the tubular portion 11.

The tubular portion 11 defines a chamber 13 in which a terminal insert 14 is received. The chamber 13 is terminated by the end wall 12, which has a thin, highly elastic portion 27 at its center defining an opening 15 therethrough. An electrical cable 16 extends through the opening 15 and into the chamber 13 for connetion with the electrical elements of the terminal part 14, as is well known. Due to the flexibility and resiliency of the portion 27 of the end wall 12, a fluidtight seal encompasses the cable 16.

The insert 14 has a portion 14A which is received in a groove 14B formed in the inner wall 13A defining chamber 13. The groove 14B provides for proper positioning of the terminal insert 14 in the chamber 13 during assembly so holes 18 in the terminal insert 14 are aligned with holes 21 in the end wall 12.

Due to the seal around the insert 14 provided by chamber 13 and the seal around cable 16 provided by portion 27 of the end wall 12, the electrical elements of the insert 14 are substantially isolated from foreign matter that may be in the vicinity of the connector. As a result, the connector 10 is particularly adaptable for industrial use, since foreign matter, such as oil, which may be in the vicinity, is effectively isolated from the electrical element of insert 14.

The present invention includes the use of sleeves 19 which penetrate the end wall 12 through holes 21 when screws 17 secure the terminal insert 14 to the clamping bracket 20. Sleeves 19 may be integrally molded to either the clamping bracket (as shown in FIG. 1) or to the terminal insert. In either case, the sleeves extend through the end wall 12.

Figure 2:
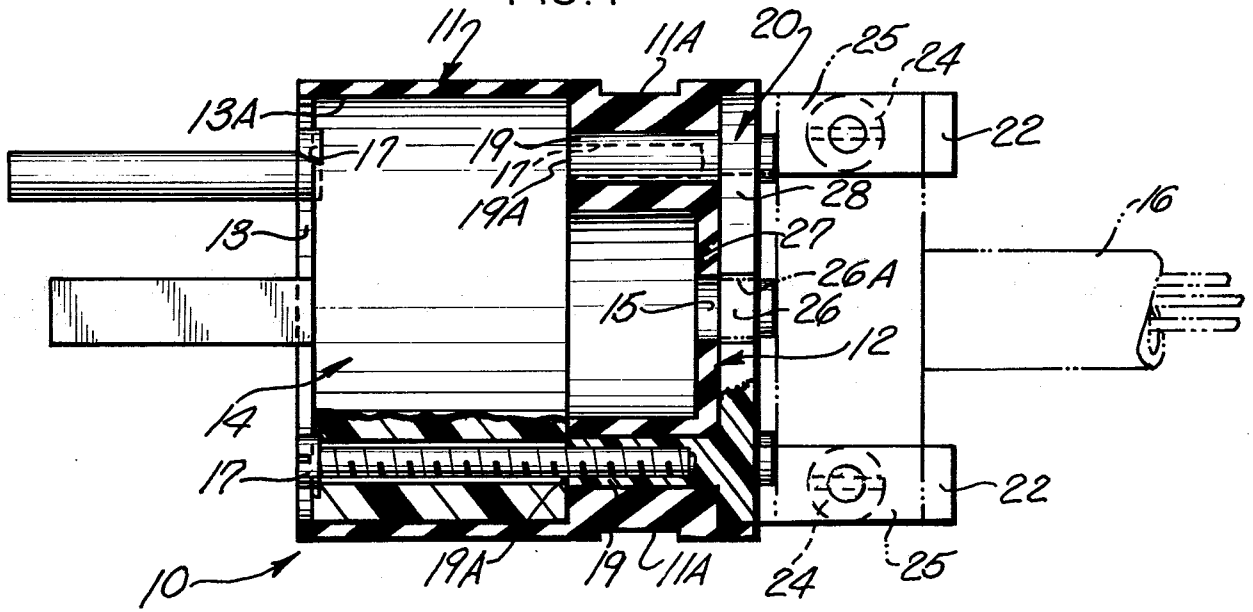
FIG. 2 is a cross-sectional view of the assembled connector.

As best shown in FIG. 2, the sleeves 19 have a length such that the terminal insert part 14 engages the outer end surface 19A of the sleeves without forcefully engaging the adjacent surface of the tubular casing 10. As a result, compressive forces are not applied to the casing and lateral bulging of the material of the casing does not occur. Accordingly, two connectors of the present invention can be used in a dual electrical receptacle without interference.

The clamping bracket 20, shown in FIG. 1, consists of an annular body 28 with the sleeves 19 extending to the left and rectangular protrusions 22 extending to the right providing means for mounting semicircular clamping elements 25. Screws 24, preferably self-tapping, secure the clamping elements 25 around cable 16 so a to prohibit movement of the cable after assembly. The semicircular indentation 26 in the clamping bracket 20 is designed to engage the protrusion 26A in the body 10, thereby providing for proper positioning of the clamping bracket 20 into the body 10 during assembly.

Having described my invention, I claim:

1. An electrical connector comprising a body defining a chamber having an end wall closing one end of said body, electrical elements carried by an insulating part located in said chamber, said body having an integral molded construction of resilient material and including a generally tubular portion, means defining an opening in said end wall for an electrical cable to extend therethrough into said chamber for connection with said electrical elements, said end wall having a portion defining said opening and which has a fluidtight sealing engagement with said cable, a plurality of longitudinally extending sleeve receiving openings in said end wall, clamp means for clamping said electrical cable prior to its entry into said chamber, said clamp means comprising a clamp part and means for securing said clamp part to said insulating part, said means comprising threaded fasteners which extend into threaded engagement with said clamp part, said electrical connector having means for preventing an axial compressive clamping of said body between said insulating part and said clamp part, and said means comprising a plurality of sleeves extending from one of said parts for end wall penetrating movement into said sleeve receiving openings and for engaging the other of said parts and blocking compressive engagement of the other of said parts with said body so that a compressive action does not occur to said body which would cause bulging thereof, said sleeves being of uniform cross-sectional dimension throughout their extent and being removably slidably received in said sleeve receiving openings.

2. An electrical connector as defined in claim 1 wherein said sleeves and clamp part are a one-piece integrally formed plastic part.

3. An electrical connector as defined in claim 2 wherein said sleeves have openings therein for receiving said respective fasteners.

4. An electrical connector comprising, a casing defining a chamber for receiving a terminal insert, said casing having an integral molded flexible construction and including a generally tubular portion and an end wall closing one end of said tubular portion, means defining an opening in said end wall for an electrical cable to extend therethrough into said chamber for connection with the electrical elements contained in the terminal insert, said end wall having a portion defining said opening and which has a fluidtight sealing engagement with said cable, a plurality of longitudinally extending sleeve receiving openings in said end wall, a clamping attachment consisting of a clamping bracket having mounting plates projecting from an external surface of said bracket and which accommodate clamping parts which secure the electrical cable prior to its entry into said chamber, a fastening means for securing clamping parts together in clamping engagement with said cable, sleeve elements slidably removably positioned in said end wall intermediate said clamping bracket and said terminal insert and integrally molded with at least one of said bracket and said insert to prohibit any compression of said end wall of said casing thereby preventing radial expansion of the external surface of said casing, said sleeve elements being of uniform cross-sectional dimension throughout their extent.

5. An electrical connection as defined in claim 4 wherein said elements are integrally molded to said clamping bracket and have openings for receiving fasteners for securing said clamping bracket to said terminal insert.

* * * * *

UNITED STATES PATENT OFFICE

CERTIFICATE OF CORRECTION

Patent No. 4,021,092 Dated May 3, 1977

Inventor(s) John E. Ericson, Jr.

It is certified that error appears in the above-identified patent and that said Letters Patent are hereby corrected as shown below:

Column 4, line 38 please transpose "slidably removably" to --removably slidably--.

Signed and Sealed this

*second* Day of *August 1977*

[SEAL]

*Attest:*

RUTH C. MASON
*Attesting Officer*

C. MARSHALL DANN
*Commissioner of Patents and Trademarks*